US006605647B2

(12) United States Patent
Yamada et al.

(10) Patent No.: US 6,605,647 B2
(45) Date of Patent: Aug. 12, 2003

(54) HYDROGENATION OF CARBON MONOXIDE USING SULFIDE CATALYSTS

(75) Inventors: Muneyoshi Yamada, Sendai (JP); Naoto Koizumi, Sendai (JP); Yosuke Takahashi, Sendai (JP)

(73) Assignee: President of Tohoku University, Sendai (JP)

( * ) Notice: Subject to any disclaimer, the term of this patent is extended or adjusted under 35 U.S.C. 154(b) by 0 days.

(21) Appl. No.: 09/749,544

(22) Filed: Dec. 28, 2000

(65) Prior Publication Data

US 2002/0017053 A1 Feb. 14, 2002

(30) Foreign Application Priority Data

Jul. 4, 2000 (JP) ..... 2000-202390

(51) Int. Cl.[7] ..... C07C 27/00
(52) U.S. Cl. ..... 518/715; 518/700
(58) Field of Search ..... 518/700, 715

(56) References Cited

U.S. PATENT DOCUMENTS

| | | | |
|---|---|---|---|
| 4,119,656 | A | 10/1978 | Poutsma et al. |
| 4,151,190 | A | 4/1979 | Murchison et al. |
| 4,199,522 | A | 4/1980 | Murchison et al. |
| 4,235,798 | A | 11/1980 | Bartley et al. |
| 4,289,709 | A | 9/1981 | Kaiser |
| 4,675,344 | A | 6/1987 | Conway et al. |
| 4,752,623 | A | 6/1988 | Stevens et al. |

FOREIGN PATENT DOCUMENTS

| | | |
|---|---|---|
| JP | 55-139324 | 10/1980 |
| JP | 55-139325 | 10/1980 |
| JP | 61-091139 | 5/1986 |
| JP | 4-051530 | 8/1992 |

OTHER PUBLICATIONS

Ryukabutu Binran (Hanbook of Sulfides), Shin Nippon Tantyuzo Kyokai, Jul. 15, 1994, pp. 16–17, 206–213.

S.A. Hedrick, et al., Activity and Selectivity of Group VIII, Alkali–Promoted Mn–Ni, and Mo–based Catalysts for $C_{2+}$ Oxygenate Synthesis from the CO Hydrogenation and $CO/H_2/C_2H_4$ Reactions, Catalysts Today, 55 (2000), pp. 247–257.

C.H. Bartholomew, et al., "Sulfur Poisoning of Metals", Advances in Catalysts, Academic Press, New York, 1982, vol. 31, pp. 132–242.

A. Holmen, et al., "Natural Gas Conversion," Proceedings of the Natural Gas Conversion Symposium, Oslo, Aug. 12–17, 1990, Studies in Surface Science and Catalysis, vol. 61, pp. 225–234, 265–271.

H. E. Curry–Hyde, et al., "Natural Gas Conversion II," Proceedings of the Third Natural Gas Conversion Symposium, Sydney, Jul. 4–9, 1993, Studies in Surface Science and Catalysis, vol. 81, pp. 43–71.

T. A. Pecoraro, et al., "Hydrodesulfurization Catalysis by Transition Metal Sulfides," Journal of Catalysis, 67, 1981, pp. 430–445.

Steven S. C. Chuang, et al., "Infrared Study of the CO Insertion Reaction on Reduced, Oxidized, and Sulfided $Rh/SiO_2$ Catalysts," Journal of Catalysis, 135, 1992, pp. 618–635.

S. A. Hedrick, et al., "Activity and Selectivity of Group VIII, Alkali–Promoted Mn–Ni, and Mo–Based Catalysts for $C_{2+}$ Oxygenate Synthesis from the CO Hydrogenation and $CO/H_2C_2H_4$ Reactions," Catalysts Today, 55, 2000, pp. 247–257.

Proceedings for the 78$^{th}$ Spring Symposium, 2000, Nippon Kagaku Gakkai, Thesis 4 H3 03, Mar. 15, 2000.

Jikken Kagaku Koza 4$^{th}$ ed. 16, Inorganic Compounds, chemical Society of Japan, pp. 245–273, Dec. 5, 1990.

*Primary Examiner*—Jafar F Parsa
(74) *Attorney, Agent, or Firm*—Oblon, Spivak, McClelland, Maier & Neustadt, P.C.

(57) ABSTRACT

A method of producing synthetic fuels by hydrogenating carbon monoxide comprising contacting a feed gas containing carbon monoxide and hydrogen with a metal sulfide catalyst comprising:

(1) at least one element selected from the group consisting of Rh, Pd, Pt, and Hf; and optionally
(2) solid acid.

20 Claims, No Drawings

HYDROGENATION OF CARBON MONOXIDE USING SULFIDE CATALYSTS

CROSS-REFERENCE TO RELATED APPLICATIONS

This application is based upon and claims the benefit of priority from the prior Japanese Patent Application No. 2000-202390, filed Jul. 4, 2000, the entire contents of which are incorporated herein by reference.

BACKGROUND OF THE INVENTION

This invention relates to a process for hydrogenating carbon monoxide. More specifically, this invention relates to a process for producing synthetic fuels having low environmental impact from synthesis gas. In one aspect, this invention concerns a catalyst for use in the hydrogenation of carbon monoxide.

Useful organic chemicals have been produced from carbon resources like petroleum, coal, natural gas and biomass in the following manner. Firstly, synthesis gas, a mixture of carbon monoxide and hydrogen, is produced through the reforming reaction or the coal gasification. The synthesis gas is then allowed to react on specific catalysts at high temperature and high pressure, thus converted to hydrocarbons like alkane and alkene, and oxygenates like alcohol and ether.

These organic chemicals thus obtained can suppress the emission of toxic substances when used as a fuel, since they do not contain sulfur compounds and nitrogen compounds owing to their distinctive manufacturing processes. In particular, methanol, which is mostly produced from the synthesis gas and used as a gasoline additive, has recently received much attention as a hydrogen source for the fuel cell. In the stream of rising environment-conscious, an improved manufacturing method with higher productivity is desired.

In the reaction of synthesis gas, catalysts including metals such as Cu, Fe and Co are generally used. Typical review articles are in the texts "Studies in surface science and catalysis, vol. 61, NATURAL GAS CONVERSION", A. Holmen et al., Elsevier (1991) and "Studies in surface science and catalysis, vol. 81, NATURAL GAS CONVERSION", H. E. Curry-Hyde, R. F. Howe, Elsevier (1994).

In spite of their drawbacks of requiring high temperature and high pressure conditions, these catalysts are commercially widely used because of their low costs and availability. However, these catalysts are easily poisoned by various chemical substances in feed gases, particularly by a slight amount of sulfur compounds such as hydrogen sulfide. To avoid this sulfur poisoning, sulfur compounds must be removed to quantity of the order of ppb by installing a desulfurization facility before the reforming or hydrogenation reaction process. Consequently, when the conventional catalysts are used, the manufacturing process becomes complicated and expensive.

Japanese Patent Application KOKAI Publication No. 55-139325 discloses a process for the production of hydrocarbons with sulfur tolerant catalysts having a surface area less than about 100 $m^2/g$ and consisting essentially of the metal, oxide or sulfide of Mo, W, Re, Ru, Ni, Pd, Rh, Os, Ir and Pt, and alkali or alkaline earth. In this application, it is noted that a catalyst consisting of $MoO_3$, $K_2O$ and carborundum shows no remarkable change in activity (carbon monoxide conversion rate) and gaseous alkene selectivity whether the synthesis gas contains 20 ppm of hydrogen sulfide or not.

Japanese Patent Application KOKAI Publication No. 55-139324 discloses a process for the production of $C_{2-C4}$ hydrocarbons from the mixture of carbon monoxide and hydrogen with supported catalysts consisting essentially of the metal, oxide or sulfide of Mo, W, Re, Ru, and Pt, and alkali or alkaline earth. According to this application, these catalysts temporarily show low activity when 100 ppm of hydrogen sulfide is introduced into the feed gas, but are regenerated after the feed gas is stopped and hydrogen is fed on them at 500–600° C. for one day. It indicates that the catalysts show only low activity in the poisonous atmosphere including sulfur compounds of the quantity of ppm order, and that the feed gas must be once stopped for the contamination of sulfur compounds.

Japanese Patent Application KOKAI Publication No. 61-91139 discloses a method for producing alkene by contacting synthesis gas with a catalyst comprising Mn oxide, alkali metal, sulfur, and Ru. Japanese Patent Application KOKOKU Publication No. 4-51530 discloses a manufacturing method of mixed alcohol with a sulfide catalyst comprising Mo, an alkali promoter, and a support. The latter has the disadvantage of requiring high pressure of at least 7 MPa, usually 10 MPa, for reaction.

As mentioned above, the conventional commercial catalysts for the production of synthetic fuels from synthesis gas are deactivated by sulfur compounds (sulfur poisoning), so that the content of the sulfur compounds must be lowered to the order of ppb before the reaction by means of the upstream desulfurization unit.

On the other hand, aforementioned sulfide catalysts containing Mo or W require high-pressure conditions to achieve proper activity and selectivity.

BRIEF SUMMARY OF THE INVENTION

The object of the present invention is to provide a method of hydrogenating carbon monoxide with high productivity under mild conditions and with simple manufacturing process. It is another object of the present invention to provide sulfide catalysts with high durability, especially excellent sulfur tolerance in the production of synthetic fuels.

According to a first aspect of the present invention, there is provided a method of producing synthetic fuels by hydrogenating carbon monoxide comprising contacting a feed gas containing carbon monoxide and hydrogen with a metal sulfide catalyst comprising at least one element selected from the group consisting of Rh, Pd, Pt, and Hf.

According to a second aspect of the present invention, there is provided a method of producing synthetic fuels by hydrogenating carbon monoxide comprising contacting a feed gas containing carbon monoxide and hydrogen with a catalyst consisting of a solid acid, preferably γ-alumina, and a metal sulfide comprising at least one element selected from the group consisting of Rh, Pd, Pt, and Hf.

In the present invention, the feed gas may contain from 1 to 10,000 ppm of sulfur compounds. The molar ratio of hydrogen to carbon monoxide ($H_2/CO$) in the feed gas is preferably within the range from 1 to 5. The feed gas is contacted with the sulfide catalysts preferably at 100–400° C. and at 0.1–10 MPa.

DETAILED DESCRIPTION OF THE INVENTION

The catalyst used in the practice of the invention is a metal sulfide catalyst comprising at least one element selected from the group consisting of Rh, Pd, Pt, and Hf. This metal sulfide catalyst is prepared by sulfiding a metal or a metal compound precursor comprising at least one element selected from the group consisting of Rh, Pd, Pt, and Hf. The sulfiding may be accomplished at the catalyst preparation prior to loading it into the reactor or after loading the precursor into the hydrogenation reaction vessel.

The sulfiding at the catalyst preparation may be carried out by contacting sulfur compounds with the metal; halide such as chloride and bromide; oxide; inorganic salt such as nitrate, phosphate, sulfate, and ammonium salt; organic salt such as acetic salt; carbonyl compound; or chelate. These sulfur compounds include sulfur; alkali metal sulfide such as lithium sulfide, sodium sulfide, and potassium sulfide; ammonium sulfide; carbon disulfide; hydrogen sulfide; and organic sulfide compounds.

The sulfiding after loading the metal or the metal compound precursor into the hydrogenation reaction vessel may be carried out by contacting the metal, halide, oxide, nitrate, or chelate with alkali metal sulfide such as lithium sulfide, sodium sulfide, and potassium sulfide; ammonium sulfide; hydrogen sulfide; etc. The sulfiding may be accomplished by flowing a sulfide compound such as hydrogen sulfide or thiophene with gradually increasing the temperature up to 150–250° C. and then to the predetermined operation temperature where temperature is maintained for 1–4 hours.

Besides the aforementioned sulfiding techniques, any conventional method of sulfiding can be used. An example is described in the paper "Hydrodesulfurization Catalysis by Transition Metal Sulfides", T. A. Pecoraro and R. R. Chianelli, Journal of Catalysis, 67, 430–445 (1981). According to this paper, a metal chloride is dissolved in ethyl acetate and lithium sulfide is added with stirring. Then the solution is filtered to yield a metal sulfide. The solid is heat treated in a tube furnace in $H_2S$ or $H_2S/H_2$ at 400° C., cooled to room temperature, washed with acetic acid, filtered, and heated again in $H_2S$ or $H_2S/H_2$, finally producing the corresponding metal sulfide.

Another example is described in the text, "JIKKEN KAGAKU KOZA 4$^{th}$ ed. 16. Inorganic Compounds", Chemical Society of Japan, pp. 246–271, or "RYUKABUTU BINRAN (Handbook of sulfides)", SHIN NIPPON TANTYUZO KYOKAI. The latter text describes the most common methods of preparing sulfides as follows:

1. Direct reaction between a metal and sulfur. This method can generate various compositions of sulfides. Depending on the affinity between a metal and sulfur, the reaction is carried out at room temperature (e.g. $2K+S=K_2S$) or high temperature (e.g. $Fe+S=FeS$).
2. Reduction of an oxide by sulfur ($2CdO+3S=2CdS+SO_2$, 280–425° C.), $H_2S$ ($La_2O_3+3H_2S=La_2S_3+3H_2O$, 1000–1200° C.), $CS_2$ ($TiO_2+CS_2=TiS_2+CO_2$, 800° C.).
3. Reduction of a sulfate by carbon ($Na_2SO_4+4C=Na_2S+4CO$), $H_2$ ($Li_2SO_4+4H_2=Li_2S+4H_2O$).
4. Reaction between an element and $H_2S$ ($2Ga+3H_2S=Ga_2S_3+3H_2$, 800–1250° C.)
5. Reaction between a salt and $H_2S$ ($TiCl_4+2H_2S=TiS_2+4HCl$, 600–1000° C.)
6. Reaction between a hydroxide and $H_2S$ via the formation of an acidic sulfide. ($NaOH+H_2S=NaHS+H_2O$, $NaHS+NaOH=Na_2S+H_2O$)
7. Precipitation of an acidic solution by the addition of $H_2S$ (sulfides of As, Sb, Sn, Ag, Hg, Pb, Bi, Cu, Cd) and $(NH_4)_2SO_4$ (sulfides of Zn, Mn, Co, Ni, Fe)
8. Preparation of a low sulfur-content sulfide by the pyrolysis of a polysulfide and by the reaction between a polysulfide and an oxide occasionally in the presence of a reductant; the polysulfide can be prepared by blending a sulfide and sulfur or the reaction between a metal and sulfur in an ammonia solution. (e.g. A polysulfide of an alkali metal can be prepared by the reaction of a hydride and sulfur: $2LiH+3S=Li_2S_2+H_2S$.)

The sulfiding can also be carried out by treating a metal compound precursor with sulfur compounds contained in the feed gas in high concentrations during the hydrogenation reaction.

The metal sulfide catalysts in the present invention may contain metals such as Ti, V, Mn, Fe, Co, Zr, and Mo, alkali metal such as Na, K, and Mg, alkaline earth metal, and lanthanoid or actinoid such as La and Th, unless they lessen the effect of the present invention. These materials may be used at the amount from 0.1 to 100 parts by weight of the metal sulfide. The metal sulfide catalysts in the present invention may be used in either bulk or supported form.

The exemplary support materials include inorganic oxides such as silica, alumina, fluorinated alumina, boria, magnesia, titania, zirconia, silica-alumina, alumina-magnesia, alumina-boria, alumina-zirconia, silicoalumino phosphate, and zeolite; clay minerals such as montmorillonite, kaolin, halloysite, bentonite, attapulgite, kaolinite, and nacrite; and carbon. These materials may be used alone or in combination thereof. Although any number of materials can serve as a support, neutral supports such as silica, carbon, titania, and zirconia are preferred, and silica is most preferred. The support may contain nonmetallic elements such as boron and phosphorus.

In preparation of supported catalysts, the supports may be impregnated by techniques known as the wet, dry, and vacuum impregnations.

The preferred amount of loaded metal depends on the property of the support and can not be inclusively determined, but it may be 1–30 mass %, more preferably 5–10 mass % of the catalyst. When this amount is less than the above value, the activity (carbon monoxide conversion rate) per unit of weight of catalyst might be lower. On the other hand, when the amount is greater than the above value, metal sulfide might be agglomerated, so that its activity might be lower.

The sulfide catalyst in the present invention can be used in combination with solid acids. The solid acids include oxides such as alumina, alumina-silica, alumina-boria, alumina-magnesia, and silica-magnesia; zeolites such as X type, Y type, MFI type, and mordenite; and clay minerals such as montmorillonite. γ-alumina is most preferred. These solid acids can be used as supports or composites with the sulfide catalysts.

By using the composite catalyst of the solid acid and the metal sulfide, it is possible to produce dimethyl ether (DME) from synthesis gas with a single step process. DME is expected to be a next-generation clean diesel fuel and presently produced with a two-stage process: methanol synthesis and following dehydration reaction.

In the present invention, a feed gas containing carbon monoxide and hydrogen is flown over the sulfide catalyst to be converted into synthetic fuels such as methanol. When the composite catalyst is used, DME can be produced.

The molar ratio of hydrogen to carbon monoxide ($H_2/CO$) in the feed gas is preferably in the range from 1 to 5, more preferably from 1 to 3. This is because (1) the $H_2/CO$ molar ratio in the methanol synthesis reaction ($CO+2H_2=CH_3OH$) is 2, and (2) the $H_2/CO$ molar ratio in the synthesis gas produced from the reforming reaction is usually greater than unity, in most cases with excessive hydrogen.

The feed gas may contain sulfur compounds in addition to carbon monoxide and hydrogen. The content of the sulfur compounds is preferably 1–10,000 ppm, more preferably 100–2500 ppm, most preferably 100–500 ppm.

The temperature of the hydrogenation reaction is preferably 100–400° C., more preferably 300–350° C. The pressure of the hydrogenation reaction is preferably 0.1–10 MPa, more preferably 1–8 MPa.

According to the present invention, the feed gas containing carbon monoxide and hydrogen is allowed to react on the specific catalyst, so that we can obtain higher activity and higher selectivity under lower pressure conditions. On top of this, a simple or no desulfurization unit is required to treat the feed gas because of the excellent sulfur tolerance of the sulfide catalyst in the present invention. This will simplify the manufacturing process of synthetic fuels.

The present invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

The present invention is illustrated in more detail by reference to the following examples wherein, unless otherwise indicated, all percentages and ratios are by weight. In the examples, the reaction condition is as follows:

Reactor system: a high-pressure fixed-bed flow reactor

Synthesis gas: 33% carbon monoxide/62% hydrogen/5% argon

Reaction temperature: 240° C., 320° C, 340° C.

Reaction pressure: 5.1 MPa

EXAMPLE 1

Rhodium sulfide 1.0 g of rhodium chloride ($RhCl_3$) was dissolved in 100 mL of ethyl acetate and then 0.33 g of lithium sulfide ($Li_2S$) was added with stirring. The mixture was stirred at room temperature for 4 hours. The resulting precipitate was filtered, charged in a Pyrex® reactor, and treated with 5% $H_2S/H_2$ gas at the flow rate of 30 mL/min at 400° C. for 2 hours. Then the sample was cooled to room temperature, washed with acetic acid to remove chloride ion, and subjected to the sulfiding in the same manner as mentioned above.

Rhodium sulfide ($Rh_2S_3$) thus obtained was charged in the high-pressure stainless reactor, treated with 5000 ppm $H_2S/H_2$ at 400° C. and normal pressure until the total molar amount of hydrogen sulfide flowed reached three times the molar amount of rhodium. After the temperature was lowered to 320° C., the 5000 ppm $H_2S/H_2$ was stopped and the synthesis gas was fed into the reactor at the pressure of 5.1 MPa. Activity (CO conversion rate) varied with time at the beginning of the reaction. The activity was determined when the reaction was stabilized.

EXAMPLE 2

Rhodium sulfide 1.0 g of rhodium chloride ($RhCl_3$) was dissolved in 100 mL of ethyl acetate and then 0.33 g of lithium sulfide ($Li_2S$) was added with stirring. The mixture was stirred at room temperature for 4 hours. The resulting precipitate was filtered, charged in a Pyrex® reactor, and treated with 5% $H_2S/H_2$ gas at the flow rate of 30 mL/min at 400° C. for 2 hours. Then the sample was cooled to room temperature, washed with acetic acid to remove chloride ion, and subjected to the sulfiding in the same manner as mentioned above.

Rhodium sulfide ($Rh_2S_3$) thus obtained was charged in the high-pressure stainless reactor, treated with 1100 ppm $H_2S/H_2$ at 400° C. and normal pressure until the total molar amount of hydrogen sulfide flowed reached three times the molar amount of rhodium. After the temperature was lowered to 340° C., 1100 ppm $H_2S/H_2$ was stopped and the synthesis gas was fed into the reactor at the pressure of 5.1 MPa. Activity (CO conversion rate) varied with time at the beginning of the reaction. When the activity was stabilized, 200 ppm $H_2S/H_2$ was continuously added to the feed. The activities just before and during the addition of $H_2S$ are summarized in Table 1. The activities during the $H_2S$ addition were determined when the molar ratio of $H_2S$ to rhodium was 0.1 and 0.4.

Comparison 1 Commercial Methanol Synthesis Catalyst

A commercial catalyst for methanol synthesis manufactured by ICI Co. was used. The particle size was 32–42 mesh and the composition was 60% copper oxides/30% zinc oxides/10% alumina.

The catalyst was charged in the stainless reactor and exposed to the synthesis gas with a flow rate of 21 mL/min. The temperature of the reactor was increased to 120° C. at a rate of 4° C./min, held at 120° C. for 90 minutes, again increased to 210° C. at 1° C./min, held at 210° C. for 12 hours, and finally to 240° C. The pressure was 5.1 MPa.

When the activity became constant, 200 ppm $H_2S/H_2$ was mixed in the feed. The activities just before and during the addition of the $H_2S$ are summarized in Table 1. The activities during the $H_2S$ addition were determined at a molar ratio of $H_2S$ to copper of 0.1, 0.2, and 0.3.

Table 1 shows that Examples 1 and 2 have higher methanol yields per unit of weight of catalyst than Comparison 1. Moreover, the methanol yields in Example 2 remains unchanged during the introduction of $H_2S$. By contrast, the methanol yields in Comparison 1 decreases with increasing amount of $H_2S$.

TABLE 1

| | Methanol yields /g/kg-cat/h | | |
|---|---|---|---|
| | Example 1 | Example 2 | Comparison 1 |
| Feed rate (L/kg-cat/h) | 30000 | 32000 | 5400 |
| Before $H_2S$ addition | 820 | 420 | 120 |
| During $H_2S$ addition | | | |
| $H_2S/Rh$ = 0.10 | | 450 | 100 |
| $H_2S/Cu$ = 0.20 | | | 75 |
| $H_2S/Cu$ = 0.30 | | | 60 |
| $H_2S/Rh$ = 0.40 | | 430 | |

EXAMPLE 3

Silica Supported Rhodium Sulfide

A solution consisting of 0.54 g of rhodium chloride ($RhCl_3 \cdot 3H_2O$) dissolved in 10 mL of deionized water was added dropwise over 3.0 g of silica to achieve incipient wetness with the desired loading of Rh (5%). The sample was dried under vacuum at 60° C., dried at 120° C., and calcined in air at 350° C. The resulting silica supported rhodium oxide was charged in a Pyrex® reactor and treated with 5% $H_2S/H_2$ at 400° C. until the $H_2S/Rh$ molar ratio reached ninety. The sample thus obtained was transferred in the high-pressure stainless reactor, treated with 1100 ppm $H_2S/H_2$ at 400° C. and normal pressure until the $H_2S/Rh$ molar ratio reached five. After the temperature was lowered to 340° C., 1100 ppm $H_2S/H_2$ was switched to the synthesis gas with a pressure of 5.1 MPa.

At a synthesis gas flow rate of 18000 L/kg-cat/h, the methanol yield before the addition of $H_2S$ was 42.4 g/kg-cat/h (89 g/mol-Rh/h). This yield is smaller than that of Example 2 on the basis of catalyst weight, but larger than that on the molar basis.

EXAMPLE 4

Palladium Sulfide 1.0 g of palladium chloride ($PdCl_2$) was dissolved in 100 mL of ethyl acetate and then 0.26 g of lithium sulfide was added with stirring. The mixture was stirred at room temperature for 4 hours. The resulting precipitate was filtered, charged in a Pyrex® reactor, and treated with 5% $H_2S/H_2$ at a flow rate of 30 mL/min at 400° C. for 2 hours. Then the sample was cooled to room temperature, washed with acetic acid to remove chloride ion, and subjected to sulfiding in the same manner as mentioned above.

Palladium sulfide (PdS) thus obtained was charged in the high-pressure stainless reactor, treated with 1100 ppm $H_2S/H_2$ at 400° C. and normal pressure until the $H_2S$/Pd molar ratio reached two. After the temperature was lowered to 340° C., 1100 ppm $H_2S/H_2$ was switched to the synthesis gas with a pressure of 5.1 MPa. When activity became constant, 100 ppm $H_2S/H_2$ was mixed in the feed. The $H_2S$ feed was stopped when the $H_2S$/Pd molar ratio reached 0.14.

The activities just before and during the addition of $H_2S$, and after the suspension of the $H_2S$ feed are summarized in Table 2. The activities during the addition of $H_2S$ were measured when the molar ratio of $H_2S$ to the palladium was 0.05, 0.1 and 0.14.

Comparison 2 Commercial Methanol Synthesis Catalyst 0.30 g of the commercial catalyst as shown in Comparison 1 was charged in the stainless reactor and exposed to the synthesis gas with a flow rate of 30 mL/min. The temperature of the reactor was increased to 120° C. at a rate of 4° C./min, held at 120° C. for 90 min, increased again to 210° C. at 1° C./min, held at 210° C. for one hour, and finally to 240° C. The pressure was 5.1 MPa.

When activity was stabilized, 100 ppm $H_2S/H_2$ was continuously added to the feed. The $H_2S$ gas was stopped when the $H_2S$/Cu molar ratio reached 0.25.

The activities just before and during the addition of the $H_2S$, and after the suspension of the $H_2S$ feed are summarized in Table 2. The activities during the $H_2S$ feed were measured when the molar ratio of $H_2S$ to the copper was 0.05, 0.1, and 0.2.

Table 2 shows that Example 4 has higher methanol yields than Comparison 1. Although Example 4 was decreased in the methanol yields when $H_2S$ was added, a constant amount of methanol was still produced. Moreover, the methanol yields in Example 4 regained about 70% of the initial yields when the $H_2S$ was stopped.

On the other hand, the commercial catalyst showed low methanol yields and lost its activity once $H_2S$ was introduced and was not rejuvenated.

TABLE 2

| | Methanol yields /g/kg-cat/h | |
|---|---|---|
| Feed rate (L/kg-cat/h) | Example 4 21000 | Comparison 2 5400 |
| Before $H_2S$ addition | 240 | 118 |
| During $H_2S$ addition | | |
| $H_2S$/Pd = 0.05 | 90 | 114 |
| $H_2S$/pd = 0.10 | 80 | 104 |
| $H_2S$/Pd = 0.14 | 90 | |

TABLE 2-continued

| | Methanol yields /g/kg-cat/h | |
|---|---|---|
| Feed rate (L/kg-cat/h) | Example 4 21000 | Comparison 2 5400 |
| $H_2S$/Cu = 0.20 | | 83 |
| After $H_2S$ suspension | 177 | 56 |

EXAMPLE 5

Rhodium Sulfide-solid Acid Composite Catalyst 0.2 g of rhodium sulfide ($Rh_2S_3$) prepared as in Example 1 was blended with 0.1 g of calcined γ-alumina in a mortar.

The resulting composite catalyst was charged in the stainless reactor and exposed to 1100 ppm $H_2S/H_2$ at 400° C. and normal pressure until the $H_2S$/Rh molar ratio reached three. After the temperature was lowered to 340° C., the $H_2S$ gas was switched to the synthesis gas with a flow rate of 18000 L/kg-$Rh_2S_3$/h at 5.1 MPa.

At the steady-state conditions, 190 g/kg-$Rh_2S_3$/h of DME and 40 g/kg-$Rh_2S_3$/h of methanol were produced. The DME yield is equivalent to 264 g/kg-$Rh_2S_3$/h of methanol on the assumption that two moles of methanol are converted to one mole of DME.

On rhodium sulfide in Example 1, 300 g/kg-$Rh_2S_3$/h of methanol was produced at the same conditions with Example 5 except the feed rate was 20000 L/kg-$Rh_2S_3$/h. This result indicates that the composite catalyst in this example has a comparable activity to the rhodium sulfide. Consequently, the composite catalyst in the present invention enables a single step process of producing DME, which is presently produced with the two-stage process of methanol synthesis and following dehydration reaction. The single step process has the advantage in cost and productivity.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of producing a synthetic fuel by hydrogenating carbon monoxide consisting essentially of contacting a feed gas containing carbon monoxide and hydrogen with a metal sulfide catalyst comprising at least one element selected from the group consisting of Rh, Pd, Pt, and Hf, wherein the synthetic fuel is methanol or dimethyl ether.

2. The method of claim 1 wherein said metal sulfide catalyst is a rhodium sulfide catalyst.

3. The method of claim 1 wherein said metal sulfide catalyst is a palladium sulfide catalyst.

4. The method of claim 1 wherein said metal sulfide catalyst is a platinum sulfide catalyst.

5. The method of claim 1 wherein said feed gas contains from 1 to 10,000 ppm of sulfur compounds.

6. The method of claim 2 wherein said feed gas contains from 1 to 10,000 ppm of sulfur compounds.

7. The method of claim 3 wherein said feed gas contains from 1 to 10,000 ppm of sulfur compounds.

8. The method of claim 4 wherein said feed gas contains from 1 to 10,000 ppm of sulfur compounds.

9. A method of producing a synthetic fuel by hydrogenating carbon monoxide consisting essentially of contacting a feed gas containing carbon monoxide and hydrogen with a catalyst consisting of a solid acid and a metal sulfide comprising at least one element selected from the group consisting of Rh, Pd, Pt, and Hf, wherein the synthetic fuel is methanol or dimethyl ether.

10. The method of claim 9 wherein said solid acid is γ-alumina.

11. The method of claim 9 wherein said metal sulfide catalyst is a rhodium sulfide catalyst.

12. The method of claim 9 wherein said solid acid is γ-alumina and said metal sulfide catalyst is a rhodium sulfide catalyst.

13. The method of claim 9 wherein said feed gas contains from 1 to 10,000 ppm of sulfur compounds.

14. The method of claim 10 wherein said feed gas contains from 1 to 10,000 ppm of sulfur compounds.

15. The method of claim 11 wherein said feed gas contains from 1 to 10,000 ppm of sulfur compounds.

16. The method of claim 12 wherein said feed gas contains from 1 to 10,000 ppm of sulfur compounds.

17. The method of claim 13 wherein a molar ratio of hydrogen to carbon monoxide is from 1:1 to 5:1 and said feed gas is contacted with said catalyst at a temperature of 100 to 400° C. and at a pressure of 0.1 to 10 MPa.

18. The method of claim 14 wherein a molar ratio of hydrogen to carbon monoxide is from 1:1 to 5:1 and said feed gas is contacted with said catalyst at a temperature of 100 to 400° C. and at a pressure of 0.1 to 10 MPa.

19. The method of claim 15 wherein a molar ratio of hydrogen to carbon monoxide is from 1:1 to 5:1 and said feed gas is contacted with said catalyst at a temperature of 100 to 400° C. and at a pressure of 0.1 to 10 MPa.

20. The method of claim 16 wherein a molar ratio of hydrogen to carbon monoxide is from 1:1 to 5:1 and said feed gas is contacted with said catalyst at a temperature of 100 to 400° C. and at a pressure of 0.1 to 10 MPa.

* * * * *